United States Patent [19]

Leblanc et al.

[11] Patent Number: 4,648,556

[45] Date of Patent: Mar. 10, 1987

[54] PUMP/NOZZLE UNIT FOR FUEL INJECTION IN INTERNAL COMBUSTION ENGINES

[75] Inventors: Jean Leblanc, Lyons; Jean Pigeroulet, Villeurbanne; François Rossignol, Mornant, all of France

[73] Assignee: Robert Bosch GmbH, Stuttgart, Fed. Rep. of Germany

[21] Appl. No.: 630,908

[22] Filed: Jul. 13, 1984

[30] Foreign Application Priority Data

Jul. 29, 1983 [DE] Fed. Rep. of Germany ..... 3327398
Mar. 28, 1984 [DE] Fed. Rep. of Germany ..... 3411406

[51] Int. Cl.[4] ..... F02M 57/02

[52] U.S. Cl. ..... 239/88; 123/504; 123/509; 239/95

[58] Field of Search ..... 239/88, 89, 91, 93, 239/95; 123/509, 504

[56] References Cited

U.S. PATENT DOCUMENTS

| | | | |
|---|---|---|---|
| 1,852,191 | 4/1932 | Salisbury | 239/88 |
| 2,096,711 | 10/1937 | Fielden | 239/95 |
| 2,144,861 | 1/1939 | Truxell, Jr. | 239/95 |
| 2,144,862 | 1/1939 | Truxell, Jr. | 299/107.2 |
| 2,740,668 | 4/1956 | Paluch et al. | 239/91 |

FOREIGN PATENT DOCUMENTS

| | | | |
|---|---|---|---|
| 405980 | 4/1934 | United Kingdom | 239/89 |

*Primary Examiner*—Joseph F. Peters, Jr.
*Assistant Examiner*—Scott S. Malpede
*Attorney, Agent, or Firm*—Edwin E. Greigg

[57] ABSTRACT

A pump/nozzle unit having a piston injection pump and an injection nozzle which includes a pump piston that is driven via a drive tappet and is rotatable via a regulating sleeve. The regulating sleeve is inserted into a recess on the end face of the pump housing and is axially secured in its installed state by means of a guide bushing. The guide bushing comprises a guide part for the drive tappet and a flange radially protruding beyond the outer diameter of the tappet spring, the flange being secured on the pump housing by a holder mechanism. The forces exerted upon the pump/nozzle unit during operation are absorbed by a securing arrangement. The drive assembly unit, including the drive tappet, tappet spring, guide bushing and pump piston, which is held together by a loss-preventing device, can be mounted outside the pump/nozzle unit and removed as a unit for purposes of mounting and inspecting the regulating sleeve, and even in the demounted or disassembled state of the pump-/nozzle unit this drive assembly unit remains joined to the pump/nozzle unit by the holder mechanism.

13 Claims, 9 Drawing Figures

FIG.7
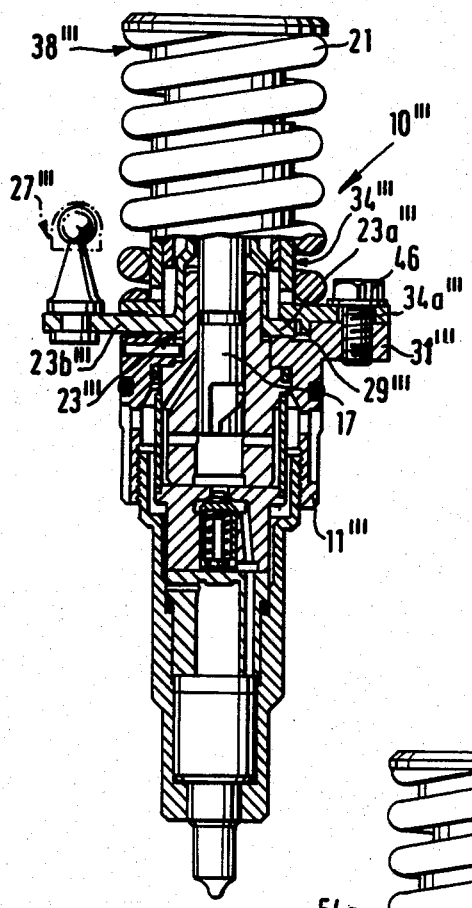
FIG.8
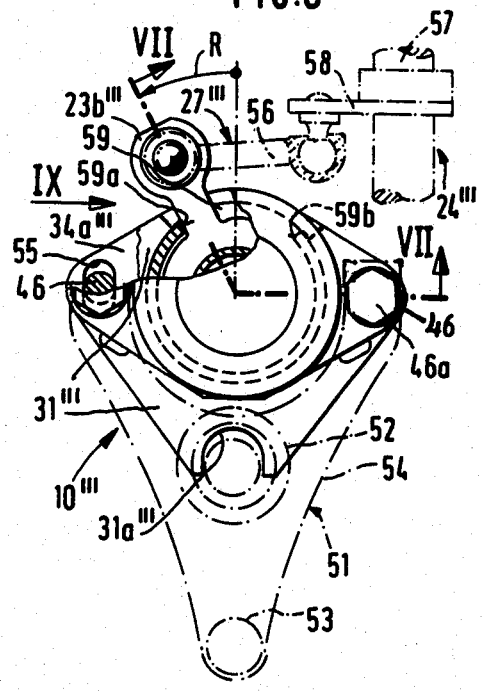
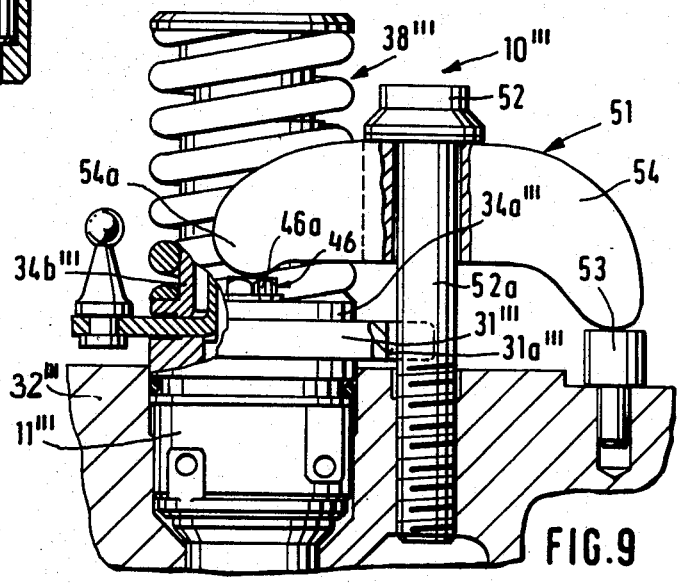
FIG.9

PUMP/NOZZLE UNIT FOR FUEL INJECTION IN INTERNAL COMBUSTION ENGINES

BACKGROUND OF THE INVENTION

The invention is based on a pump/nozzle unit for fuel injection in internal combustion engines. A pump/nozzle unit of this type is already known (U.S. Pat. No. 2,144,862), in which the piston injection pump and the injection nozzle are combined in a common pump housing into a unit mounted on the cylinder head of the internal combustion engine. To attain a change in the effective supply stroke or supply quantity, the pump piston, which is actuatable by the engine camshaft via a drive tappet counter to the force of a tappet spring and is provided with at least one oblique control edge, is rotatable by means of a regulating sleeve, disposed coaxially with it and permitting a stroke movement of the pump piston yet carrying the pump piston along with it in the direction of rotation, and by a governor rod engaging this sleeve and embodied as a supply quantity adjusting member. The regulating sleeve is inserted into a recess countersunk in the pump housing beginning at an end face on the drive side, and it is fixed in the axial direction in its installed position by a guide bushing, or by a disc secured by means of this bushing. The drive tappet is received and guided in a sleeve-like guide part of the guide bushing, and the associated tappet spring is supported on a first spring support located on the drive tappet and on a second support embodied by a disc and resting in turn on the pump housing. The guide bushing is secured in the pump housing via a threaded flange, the diameter of which is larger than that of the rest of the guide part and which is screwed into an internal thread in an enlarged part of the recess in the pump housing. Threadedly securing the guide bushing is disadvantageous in several respects. For instance, because of the thread length necessitated for the sake of strength, and the given structural length of the tappet spring, the structural length of the complete pump/nozzle unit is likewise great. The threaded connection of the components screwed to one another is incapable of preventing axial misalignments between the drive tappet and the pump piston, and if drive parts for the drive tappet are removed, the tappet spring presses the drive tappet, with the associated pump piston, outward, so that if the pump is disassembled or the drive mechanism is removed these parts may be lost. Furthermore, the guide bushing can be removed only after the tappet spring has been removed.

OBJECT AND SUMMARY OF THE INVENTION

It is accordingly a first object of the present invention to embody the guide bushing, with the tappet spring and drive tappet and optionally with the coupled pump piston as well, as a single, cohering drive unit that cannot be spread apart by the tappet spring, which in itself can be mounted outside the pump housing, and in which the force of the tappet spring is absorbed within this structural unit. A further object of the invention is that the regulating sleeve should be easy to mount and easy to remove as well as being readily and quickly accessible.

In the pump/nozzle unit according to the invention, the drive unit, which comprises the guide bushing, drive tappet and tappet spring and is kept together by the loss-preventing means, is kept joined to the pump housing carrying the other components of the pump/nozzle unit by the holder means, even when the pump/nozzle fastening screws or the drive elements are removed or when the pump/nozzle has been demounted. Should the regulating sleeve have to be removed or inspected, then after the holder means is removed the entire structural unit can be removed after the holder means is removed, without occasioning further mounting and demounting costs for this unit.

In the pump/nozzle unit according to the invention and having the characteristics defined later herein, if the guide bushing is held by the holder means and the securing means, then the holder means can be designed with relatively little strength, since in that case, where the forces arising during operation are exerted or absorbed, as the case may be, by the securing means—for instance, tightening screws or clamping shoes—which at the same time join the flange of the guide bushing and the securing flange of the pump housing to the engine housing, the holder means needs merely to prevent the component parts from falling apart.

Further advantageous provisions, structural details and further developments are disclosed herein. For instance, in the holder means embodied by a threaded sleeve, which is screwed into the threaded through bore for the securing screw and thereby holds the flange of the guide bushing firmly, no additional space is required for accommodating the holder means.

It is thus possible to retain one flange shape provided for two securing screws. If the holder means is embodied by a tightening sleeve, which in the installed state joins the flanged bushing and the pump housing, then very easy and quick mounting becomes possible because the associated securing screw, which is passed all the way through the opening formed by the tightening sleeve, exerts the required tightening force.

With a circular, protruding extension on the flange, an exact centering of the guide bushing is attained. If the regulating sleeve and the chamber, formed by the guide bushing and the recess in the pump housing, which receives it are embodied as shown in FIGS. 7–9, then in the structural type of pump/nozzle unit selected it is also possible to attain a control lever arm regulation, which is easily accessible and is actuatable with little friction.

In a pump/nozzle unit in which the holder screws of the guide bushing are each screwed through a slot in the flange of the guide bushing and on into the securing flange of the pump housing, and one radially protruding control lever arm of the regulating sleeve protrudes all the way through an arc-shaped recess in the flange area of the guide bushing, the maximum pivot range of the control lever arm is limited in at least one pivoting direction by the lateral limiting edges of this arc-shaped recess. Further stop means can thus be dispensed with, and given an appropriate adjustment. Each pump/nozzle unit can be mounted on the engine with its control lever arm resting on one limiting edge and can be joined to the governor rod in such a manner that no further operations must be performed on the engine in order to balance or adjust the fuel supply quantity.

Securing the pump/nozzle unit according to the invention by means of a clamping shoe not only secures the holder screws of the guide bushing but also holds the pump/nozzle unit firmly in its mounted position on the engine housing, and in a specialized embodiment no additional means are necessary for fixing the rotational position of the pump housing.

The invention will be better understood and further objects and advantages thereof will become more apparent from the ensuing detailed description of preferred embodiments taken in conjunction with the drawings.

BRIEF DESCRIPTION OF THE DRAWINGS

FIG. 7 is a longitudinal section taken along the line VII—VII of FIG. 8 of a fourth embodiment;

FIG. 8 is a plan view sectioned in the vicinity of the control lever arm of the fourth embodiment; and FIG. 9 is a partially sectional side view of the fourth embodiment of a pump/nozzle unit equipped with control lever arm regulation.

DESCRIPTION OF THE PREFERRED EMBODIMENTS

Figure 1:
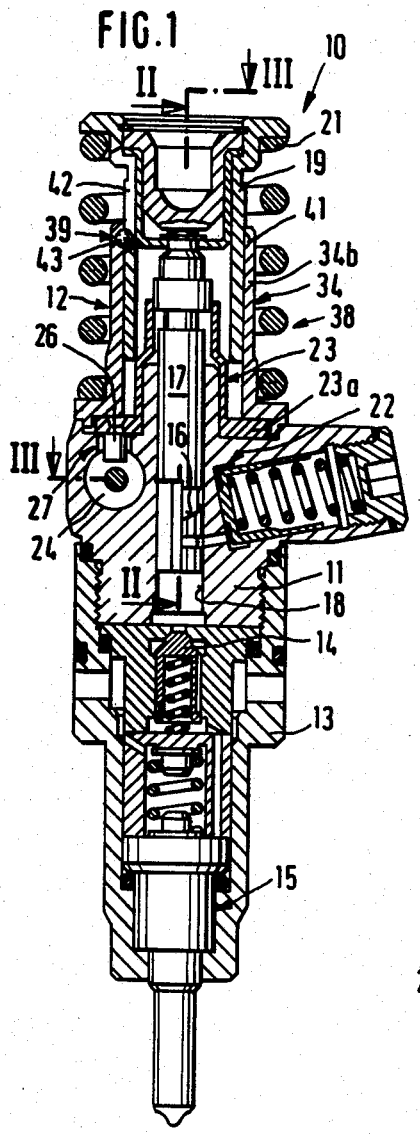
FIG. 1 is a longitudinal section taken through the first exemplary embodiment of the pump/nozzle unit according to the invention.
Figure 2:
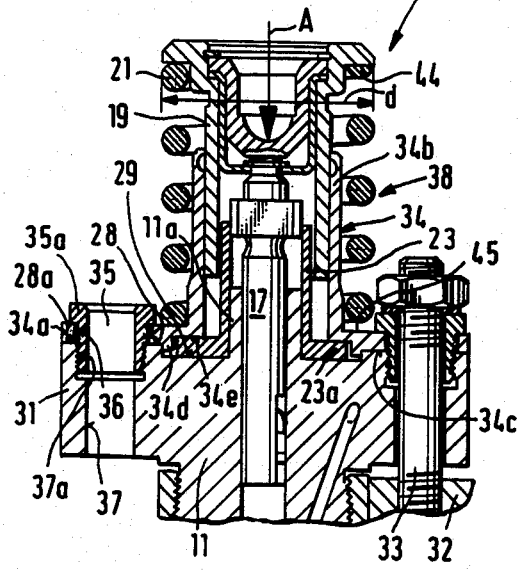
FIG. 2 is a section taken along the line II—II of FIG. 1.
Figure 3:
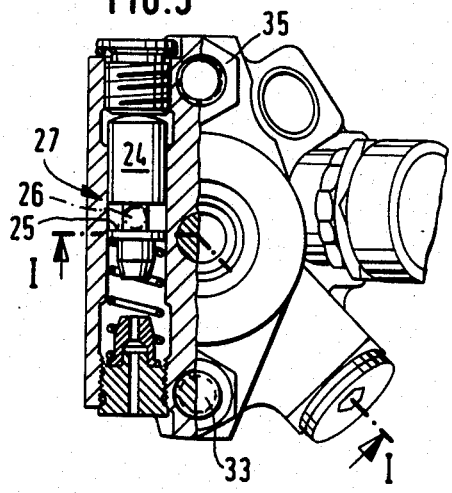
FIG. 3 is a plan view, partially in section along the line III—III of FIG. 1, of the pump/nozzle unit.

In the first exemplary embodiment of the pump/nozzle unit 10 according to the invention, shown in FIGS. 1–3, the pump housing 11 receives a piston injection pump 12 and in addition includes an injection nozzle 15 secured to its end face by means of a sleeve nut 13. A pressure valve 14 is disposed between the nozzle 15 and the pump 12; the nozzle 15 is of known design and will therefore not be described in detail.

A pump piston 17 provided with an oblique control edge 16 is guided inside the pump housing 11 in a cylindrical bore 18 and is actuated in a manner known per se via drive means (not shown) driven by the engine cam shaft, via a drive tappet 19 counter to the force of 15 a tappet spring 21, in order to attain a pump stroke in its longitudinal direction. To vary its effective supply stroke, the pump piston 17 is rotatable by means of a regulating sleeve 23 disposed coaxially with it and rotatable via a supply quantity adjusting member 24 which engages the regulating sleeve 23. The supply quantity adjusting member 24, which as shown in FIGS. 1 and 3 is embodied as an adjusting piston, carries an annular groove 25, as part of a drive device 27, the annular groove 25 being engaged by a drive bolt 26 which likewise belongs to the drive device 27; the drive bolt 26 is secured to an annular flange **23*a* of the regulating sleeve 23 and extends into the groove 25. The drive device 27 embodied by the annular groove 25 and the drive bolt 26 is thus part of a control lever arm regulating means, in which the annular flange 23*a* takes the place of an otherwise conventional control lever arm bearing the coupler bolt 26. The piston 24 is adjustable in its cylinder by a hydraulic medium entering the cylinder via a hollow screw nipple, not numbered, which hydraulic medium moves the piston in the cylinder parallel with the plane of the flange 23*a* and counter to the force of a spring (not numbered). As the piston moves, the drive bolt 26, which is secured to the regulating sleeve 23, moves in the groove 25 to rotate the regulating sleeve 23**.

As shown in detail in FIG. 2, the pump housing 11 is provided with a countersunk recess 29 beginning at an end face 28 on the drive side disposed coaxially with the pump piston 17 and serving to receive the regulating sleeve 23; this recess 29 takes the form of an end-face annular groove and surrounds an axially protruding guide neck **11*a* of the pump housing 11 which serves to improve the guidance of the pump piston 11**.

A radially protruding securing flange 31 (see FIG. 2) is located on the pump housing 11 and has the end face 28 on the drive side; securing means 33 engage this securing flange 31, in order to secure the pump/nozzle unit 10 to an internal combustion engine housing 32. Although clamping shoes can also be used as securing means, in the first three exemplary embodiments two securing screws 33 are used, comprising stay bolts and screw threaded nuts; for the sake of clarity, only one securing screw 33 is shown in the drawing. At the same time, the securing screws 33 also clamp a flange **34*a* of a guide bushing 34 against the end face 28 on the securing flange 31, when the pump/nozzle unit 10 is mounted on the engine housing 32. To this end, the flange 34*a*, which protrudes radially outward beyond the outside diameter d of the tappet spring 21, extends into the zone 28*a* of the end face 28 which is engaged by the securing screws 33 of the pump/nozzle unit 10. The guide bushing 34, which is provided with a sleeve-like guide part 34*b* for the drive tappet 19 and at its end face acts as a means of axial positional fixation for the regulating sleeve 23, is secured on the securing flange 31 of the pump housing 11 not only by the securing screws 33 but also by additional holder means, embodied by threaded sleeves 35. To this end, the threaded sleeve 35, which is disposed coaxially with the securing screw 33 and is screwed all the way through a corresponding bore 36 in the flange 34*a* and into a threaded section 37*a* in an associated bore 37 of the securing flange 31, is provided with a radial collar 35*a*. With this collar 35*a*, the flange 34*a* of the guide bushing 34 is secured to the securing flange 31 of the pump housing 11. This securing means is not required to exert large forces, because it acts merely to secure the elements while they are being transported; the forces exerted during operation are absorbed by the securing screws 33. Even if the pump/nozzle unit 10 is disassembled or removed, or if the securing screws 33 are loosened, the end face 34*c* of the flange 34*a* is kept in contact with the end face 28 of the pump housing 11. After the threaded sleeves 35 are removed, the entire drive assembly 38, comprising the drive tappet 19, the tappet spring 21 and the guide bushing 34, as well as the pump piston 17 coupled to it, can be removed as a single unit which is held together by a loss-preventing means 39**.

The loss-preventing means 39 is embodied by a ball 43 placed into an annular groove 41 in the guide part **34*b* of the guide bushing 34 and additionally guided in a longitudinal groove 42 in the drive tappet 19. The longitudinal groove 42 enables the required stroke movement of the drive tappet 19, but its axial limitation prevents the spreading apart of the components of the drive assembly 38 caused by the tappet spring 21 if the drive forces exerted in the direction of the arrow A upon the drive tappet 19 either are absent, after the removal of the corresponding drive elements, or cannot become effective, if the pump/nozzle 10 is removed. The pressure exerted by the tappet spring 21 is absorbed inside this assembly 38, because the tappet spring 21 rests on one end against a first spring support 44 on the drive tappet 19 and on the other end against a second spring support 45, the latter embodied by an annular shoulder and the guide bushing 34 and being relieved toward the pump housing 11**.

In order to assure perfect centering of the guide bushing and prevent any axial misalignment from occuring between the pump piston 17 and the drive tappet 19, the guide bushing 34 is inserted into the recess 29 of the pump housing 11 with an arc-shaped extension **34*d* that protrudes from the end face 34*c* of its flange 34*a*. An indentation 34*e* on the end face inside this extension 34*d* and the recess 29 in the pump housing 11 together form a chamber which encompasses or surrounds a radially offstanding annular flange 23*a* of the regulating sleeve 23 on three sides and thus guides the regulating sleeve 23** in the axial direction.

Figure 4:
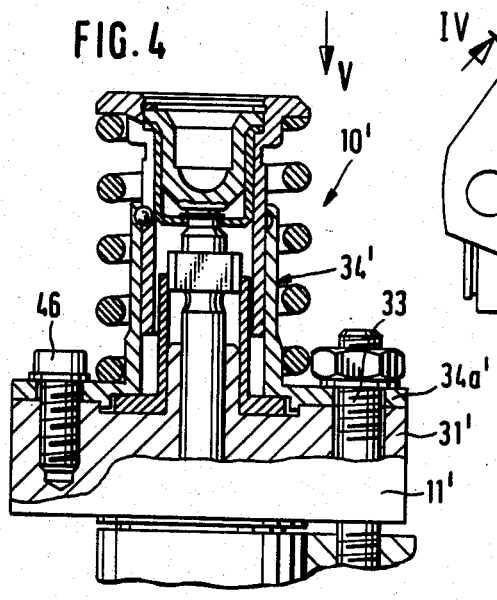
FIG. 4 is a partial longitudinal section taken along the line IV—IV of FIG. 5, showing the essential characteristics of the second exemplary embodiment of the invention.
Figure 5:
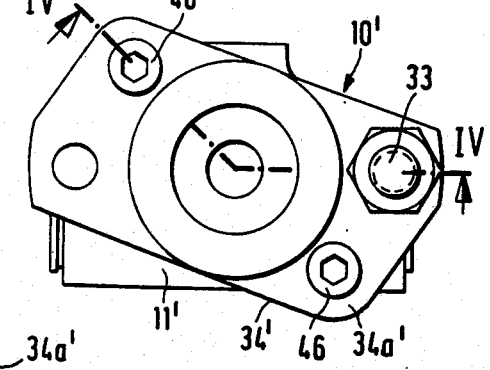
FIG. 5 is a plan view in the direction of the arrow V of FIG. 4.
Figure 6:
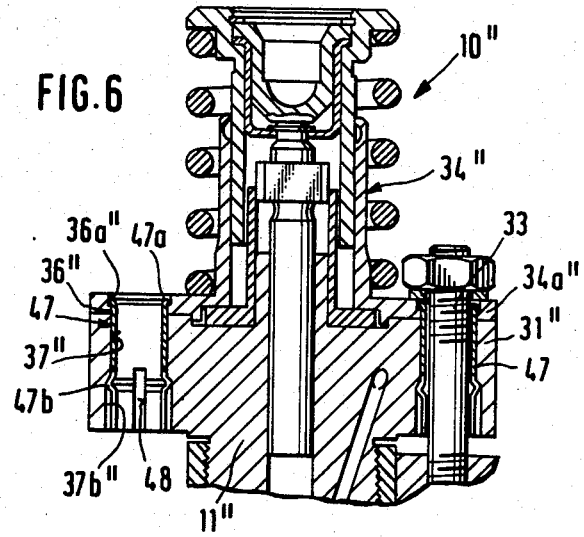
FIG. 6 is a section corresponding to FIG. 4, but taken through the third exemplary embodiment of the invention.

The next two exemplary embodiments, shown in FIGS. 4–6, differ from the first exemplary embodiment only in terms of the holder means for the guide bushing; the fourth exemplary embodiment, shown in FIGS. 7–9, additionally differs in having different securing means. Identical elements are therefore provided with identical reference numerals, while those that differ are provided with a single, double or triple prime, and new elements are identified by new reference numerals.

In the second exemplary embodiment of a pump/nozzle unit 10' shown in FIGS. 4 and 5, the holder means for the guide bushing 34' is embodied by two holder screws 46, which are separate from the securing screws 33 and join the flange **34*a'* of the guide bushing 34' to the securing flange 31' of the pump housing 11'. The holding force required may optionally be exerted by merely a single holder screw 46, since when the pump/nozzle unit 10' is in the installed state, the two securing screws 33 keep the guide bushing 34' pressed against the securing flange 31'**.

In the third exemplary embodiment of a pump/nozzle unit 10'' shown in FIG. 6, the holder means for the guide bushing 34'' is embodied by a clamping sleeve 47. This clamping sleeve 47 is passed through the two coaxially disposed bores 36'' and 37'' in the flange **34*a''* of the guide bushing 34'' and in the securing flange 31'' of the pump housing 11'' and keeps the two flanges 34*a''* and 31''** together.

To this end, the clamping sleeve 47 is manufactured from a spring-elastic material, such as spring band steel or hard brass, and with a first annular bulge **47*a* disposed on its end it engages an enlargement 36*a''* of the bore 36'' contained in the flange 34*a''* of the guide bushing 34'' and with a second, yieldingly resilient annular bulge 47*b* it engages an enlargement 37*b''* of the bore 37'' to make a detent. In the vicinity of the second annular bulge 47*b*, the clamping sleeve 47 is incised by a plurality of longitudinal slits 48 to such an extent that when the guide bushing 34'' is mounted on the pump housing 11'', the clamping sleeve 47 can be introduced from above and then subsequently holds the flange 34*a''* firmly in contact with the securing flange 31. In this third exemplary embodiment, even more clearly than in the first, no additional space is required to accommodate the holder means for the guide bushing 34'', and so the securing flange 31'' can maintain its structural shape that is fixed by the disposition of the two securing screws 33**.

The fourth exemplary embodiment of a pump/nozzle unit 10''' shown in FIGS. 7–9 has as its securing means a clamping shoe fastening 51 which at least partially surrounds and grips the drive assembly 38'''. This fastening 51 comprises a securing screw 52 and a clamping shoe 54 clamped by this screw on one side against a support 53 on the engine housing 32''' and on the other side against the holder screws 46 of the guide bushing 34'''. The two shanks of a fork-like end **54*a* of the clamping shoe 54 grip halfway around the guide part 34*b'''* of the guide bushing 34''' and press against the heads 46*a* of the holder screws 46. By this means, these holder screws 46 are simultaneously secured and the required securing forces are executed, as a supplement to the holder screws 46, upon the pump/nozzle unit 10''', in addition to the holding force for the guide bushing 34''' required for the operation of the pump/nozzle unit, thereby assuring the securing of the pump/nozzle unit in the engine housing 32'''**.

A shaft **52*a* of the securing screw 52 of the clamping shoe securing means 51 is passed through a recess 31*a'''*, serving to fix the rotational position of the pump housing 11''', in the securing flange 31''' of the pump housing 11'''. As a result, additional means for securing the rotational position of the pump/nozzle unit 10'''** to the engine become unnecessary.

Serving as holder means for the guide bushing 34''', as in the second exemplary embodiment shown in FIGS. 4 and 5, are two holder screws 46, which because of the securing force of the clamping shoe 54 imposed via these screws serve merely as a means of securing the drive assembly 38''' while it is being transported. Deviating from the second exemplary embodiment, in the fourth exemplary embodiment the holder screws 46 are each screwed through a respective slot 55 in the flange **34*a''* of the guide bushing 34''' and extend on into the securing flange 31''' of the pump housing 11'''. The slots 55 are shaped such that the guide bushing 34''' is rotatable within a limited range. The regulating sleeve 23''' is furthermore provided with a radially protruding 20 control lever arm 23*b'''*, which as part of a drive device 27''' of a control lever arm regulating means is pivotable, with the interposition of an actuating tongue 56 and an actuating lever 58 adjustably secured on a rotating shaft 57, in order to adjust the supply quantity and the rotation thereupon occurring of the pump piston 17. The rotating shaft 57 together with the actuating lever 58 embody the supply quantity adjusting member 24'''. A recess 59 enabling the passage therethrough of the control lever arm 23*b'''* is also cut out in the vicinity of the flange of the guide bushing 34''', its lateral limiting edges 59*a*, 59*b* limiting the maximal pivoting range of the control lever arm 23*b'''* in at least one pivoting direction. This pivoting direction is indicated in FIG. 8 by an arrow R. In the example shown in FIG. 8, the control lever arm 23*b'''* rests against one limiting edge 59*a*, in which it fixes and limits the maximum supply quantity of the pump piston 17. The limiting edge 59*a* thus serves as a full-load or starting-quantity stop. To adjust the position illustrated, the pump/nozzle unit 10''' is taken to a test bench, where, as on the engine, it is fixed with respect to its rotational position by means of a securing screw engaging the recess 31*a'''* and fixing the pump housing 11''' in its rotational position, or by means of a fixation pin. Prior to the basic adjustment, the guide bushing 34''' is rotated counterclockwise until the slot 55 rests on the holder screw 46. Then the supply quantity is adjusted and the control lever arm 23*b'''*** restrained. The flange 34*a*''' of the guide bushing 34''' is then rotated clockwise until the limiting edge 59*a* rests on the control lever arm 23*b*'''. Now the holder screws 46 are tightened and the established position is thus fixed. On the engine, with the control lever arm 23*b*''' resting on the limiting edge 59*a* and with the pump housing 11'' fixed in its rotational position with respect to the engine housing 32''' by means of the recess 31*a*''', the drive device 27''' of the control lever arm regulating means is adjusted by means of an appropriate mounting of the actuating lever 58. In this manner, all the pump-/nozzle units 10''' of the same internal combustion engine can be coupled, without further adjusting and setting operations, to the rotating shaft 57 of the supply quantity adjusting member 24'''.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A pump/nozzle unit secured to an engine housing for fuel injection in internal combustion engines comprising:

a pump housing that receives a piston injection pump and including an injection nozzle at one end thereof;

a pump piston which is rotatably and axially guided in a cylindrical bore in said housing in order to vary the effective supply stroke, by means of a regulating sleeve disposed coaxially therewith and by means of a supply quantity adjusting member engaging the regulating sleeve via a drive device, said pump piston being actuatable via a drive tappet counter to the force of a tappet spring;

a first spring support, located on said drive tappet, and a second spring support, relieved toward the pump housing, for supporting said tappet spring;

a guide bushing secured on the pump housing and provided with a sleeve-like guide part for said drive tappet said guide bushing including an end face side forming an axial positional securing means for said pump piston regulating sleeve;

a securing flange located on said pump housing, said securing flange having an end face on said drive side of said housing engaged at least indirectly by a securing means which secures the pump/nozzles unit to the engine housing;

said guide bushing provided with a bushing flange radially protruding beyond an outer diameter of said tappet spring and extending into a set region of said end face, said end face of said flange rests on said end face on the drive side of the pump housing;

said bushing flange of said guide bushing is secured on said pump housing by means of a holder means and said securing means, and clamped against said end face on said securing flange;

said second spring support of the tappet spring is embodied by an annular shoulder on said guide bushing; and said guide part of said guide bushing and said drive tappet are equipped with loss-preventing means, by means of which at least said guide bushing, said drive tappet and said tappet spring are combined into a drive assembly unit which is also held together in a demounted state after holder means being removed from pump housing.

2. A pump/nozzle unit as defined by claim 1, in which at least one holder screw which is independent of said securing means of the pump/nozzle serves as holder means and joins said bushing flange of said guide bushing to said securing flange on the pump housing.

3. A pump/nozzle unit as defined by claim 2, in which said at least one holder screw serving as a holder means for the guide bushing is screwed all the way through a slot in the bushing flange of the guide bushing and on into the securing flange of the pump housing, that the regulating sleeve is provided with a radially protruding control lever arm, which as part of the drive device of a control lever arm regulating means is actuatable at least indirectly by said supply quantity adjusting member, and that in the flange area of the guide bushing, a recess is cut away that enables the passage therethrough of the control lever arm, said recess includes lateral limiting edges which limit the maximum pivot range of the control lever arm in at least one pivoting direction.

4. A pump/nozzle unit as defined by claim 3, in which by means of said guide bushing rotatable in a range limited by the slot and securable by the holder screw, one of the limiting edges limiting the pivoting range of the control lever arm in its one pivoting direction (R) is adjustable into a position in which, with the control lever arm resting on this limiting edge, the pump piston or each pump piston of the pump/nozzle units mounted on the same internal combustion engine, or each pump piston of the pump/nozzle units manufactured with the same setting, assumes a predetermined rotational position that is associated with a fixed fuel supply quantity.

5. A pump/nozzle unit as defined by claim 4, in which serving as the securing means of the pump/nozzle unit is a clamping shoe securing means at least partially encompassing and gripping the drive assembly unit, which securing means comprises a clamping shoe clamped by a securing screw on one side against a support on the engine housing and on the other side against the holder screw or screws of the guide bushing.

6. A pump/nozzle unit as defined by claim 3, in which serving as the securing means of the pump/nozzle unit is a clamping shoe securing means at least partially encompassing and gripping the drive assembly unit, which securing means comprises a clamping shoe clamped by a securing screw on one side against a support on the engine housing and on the other side against the holder screw or screws of the guide bushing.

7. A pump/nozzle unit as defined by claim 6, in which a shaft of said securing screw of the clamping shoe securing means is extended all the way through a recess, serving to fix the rotational position of the pump housing, in the securing flange of the pump housing.

8. A pump/nozzle unit as defined by claim 2, in which serving as the securing means of the pump/nozzle unit is a clamping shoe securing means at least partially encompassing and gripping the drive assembly unit, which securing means comprises a clamping shoe clamped by a securing screw on one side against a support on the engine housing and on the other side against the holder screw or screws of the guide bushing.

9. A pump/nozzle unit as defined by claim 1, in which at least two securing screws passing all the way through bores in said bushing flange of said guide bushing and bores in the securing flange serves as a securing means of the pump/nozzle unit, and that serving as a holder means is at least one threaded sleeve provided with a radial collar, which threaded sleeve is screwed coaxially with the securing screw and all the way through the corresponding bore in said bushing flange of the guide bushing into a threaded section in an associated bore of said securing flange and with its collar secures the said bushing flange of the guide bushing to the securing flange of the pump housing.

10. A pump/nozzle unit as defined by claim 1, in which serving as the securing means of the pump/nozzle unit are at least two securing screws extending all the way through bores in the bushing flange of the guide bushing and in the securing flange and that serving as the holder means is at least one clamping sleeve extended all the way through the coaxially disposed bores in the flange of the guide bushing and in the securing flange and holding both flanges together.

11. A pump/nozzle unit as defined by claim 10, in which said clamping sleeve is manufactured of spring-elastic material, having a first annular bulge disposed on one end engaging an enlargement of the bore contained in the flange of the guide bushing and having a second, yieldingly resilient annular bulge locked in the manner of a detent in an enlargement of the associated bore located in the securing flange.

12. A pump/nozzle unit as defined by claim 1, which comprises a recess countersunk coaxially with said pump piston and beginning at a drive-sided end face in the pump housing serving to receive the regulating sleeve, characterized in that the guide bushing is inserted into the recess of the pump housing with an arc-shaped extension protruding out of the end face of its flange.

13. A pump/nozzle unit as defined by claim 12, in which secured on the annular flange of the regulating sleeve is an axially protruding drive bolt, which as part of a drive device of a control lever arm regulating means is actuatable at least indirectly by said supply quantity adjusting member.

* * * * *